US005085534A

United States Patent [19]

Kenichi et al.

[11] Patent Number: 5,085,534

[45] Date of Patent: Feb. 4, 1992

[54] MECHANICAL PENCIL LEAD PROTECTION PIPE WITH PROTUBERANCE

[75] Inventors: Kamakura Kenichi, Saitama; Nobuo Murasawa, Chiba; Tsukasa Sasaki, Saitama; Yuichi Miyahara, Saitama; Hiroaki Okabayashi, Saitama; Tetsuya Sugiyama, Saitama; Masamitsu Nagahama, Saitama; Tsuruo Nakayama, Saitama, all of Japan

[73] Assignee: Pentel Kabushiki Kaisha, Tokyo, Japan

[21] Appl. No.: 582,839

[22] PCT Filed: Feb. 23, 1990

[86] PCT No.: PCT/JP90/00219

§ 371 Date: Oct. 4, 1990

§ 102(e) Date: Oct. 4, 1990

[87] PCT Pub. No.: WO89/09896

PCT Pub. Date: Sep. 7, 1990

[30] Foreign Application Priority Data

| | | | |
|---|---|---|---|
| Feb. 27, 1989 | [JP] | Japan | 1-21621 |
| Mar. 30, 1989 | [JP] | Japan | 1-37047 |
| Aug. 18, 1989 | [JP] | Japan | 1-96577 |
| Aug. 23, 1989 | [JP] | Japan | 1-98128 |
| Oct. 31, 1989 | [JP] | Japan | 1-128142 |
| Oct. 31, 1989 | [JP] | Japan | 1-128143 |

[51] Int. Cl.[5] ..... B43K 21/22

[52] U.S. Cl. ..... 401/65; 401/80; 401/86; 401/87

[58] Field of Search ..... 401/65, 80, 81, 86, 401/87

[56] References Cited

U.S. PATENT DOCUMENTS 4,281,939 8/1981 Mitsuya ..... 401/80 X

FOREIGN PATENT DOCUMENTS 54-40733 3/1979 Japan .
58-203099 11/1983 Japan .
60-150084 10/1985 Japan .

*Primary Examiner*—Steven A. Bratlie
*Attorney, Agent, or Firm*—Wenderoth, Lind & Ponack

[57] ABSTRACT

This invention relates to a mechanical pencil capable of utilizing effectively a writing lead and having an improved lead protection pipe. A protuberance having a surface having a hardness equal to, or higher than, that of a lead is formed on the inner surface of the lead protection pipe by dispersing and depositing powder; very small coil-like fibers having a surface having hardness equal to, or higher than, that of the lead are dispersed and deposited on the inner surface of the lead protection pipe through a base material; an inorganic film having a protuberance having hardness equal to, or higher than, that of the lead is formed on the inner surface of the lead protection pipe; or a ring-like lead retaining member is disposed inside the lead protection pipe. The lead retaining member has a treated portion having a surface having hardness equal to, or higher than, that of the lead, and a partial play relative to the inner surface of the lead protection pipe.

5 Claims, 3 Drawing Sheets

MECHANICAL PENCIL LEAD PROTECTION PIPE WITH PROTUBERANCE

BACKGROUND OF THE INVENTION

This invention relates to a mechanical pencil capable of utilizing efficiently a refill or a writing lead.

When a writing lead becomes short in conventional mechanical pencils, the lead is released from a chuck holding it such as a three-split chuck, a ball chuck. The lead released from the chuck remains between the tip of the chuck and the tip of the mechanical pencil (lead protection pipe). The lead thus left (hereinafter referred to as the "remaining lead") is merely held lightly by a lead detent. Therefore, if writing is made by this remaining lead portion, the lead rotates freely during writing and the feel of writing drops. It is therefore customary to discharge the remaining lead by pushing it by a subsequent lead or to pull it out and to discard. This phenomenon can be observed more remarkably in the case of the remaining lead which comes off from the lead detent and eventually, the lead is likely to fall.

Various proposals have so far been made in order to use up or minimize the remaining lead to use it effectively. Typical examples are as follows. A first proposal is disclosed in Japanese Utility Model Publication (Unexamined) No. 56-115284/1981, wherein the tip of the lead protection pipe is made non-round in its sectional shape by drawing it by a press, or the like. A second proposal is disclosed in Japanese Utility Model Publication (Unexamined) No. 53-109934/1979, wherein the tip of the lead protection pipe is provided with a slot and is contracted. A third is disclosed in Japanese Utility Model Publication No. 58-32959/1983, wherein a flexible thin film made of rubber or the like is integrally laminated on the inner surface of the lead protection pipe.

There are two functions required for the lead protection pipe in order to make effective utilization of the remaining lead. First, the lead protection pipe does not permit the fall of the remaining lead when it stays in the lead protection pipe (or in other words, the pipe must have the lead retaining function). Second, the lead protection pipe does not permit the rotation of the remaining lead when writing is made by use of it (or in other words, the pipe must have the writing function by the remaining lead).

The device disclosed in Japanese Utility Model Publication (Unexamined) No. 56-115284/1981 described above has the writing function by the remaining lead. However, this device is not free from the problems in that the lead is likely to rotate unless the drawing inner diameter is made sufficiently small because the lead protection pipe is drawn, variance of inner diameters is likely to occur and if the inner diameter becomes too small due to this variance, the lead is held back and cannot be fed normally. In other words, the device involves the problem of dimensional accuracy for satisfying the lead retaining function.

The device disclosed in Japanese Utility Model Publication (Unexamined) No. 53-109934/1978 described above has the writing function by the remaining lead in the same way as in Japanese Utility Model Publication (Unexamined) No. 56-115284/1981 described above. However,since fins are formed at the time of slotting, the feed of the lead is likely to be prevented by the fins and a step of removing the fins becomes necessary, with the result that productivity drops.

The device of Japanese Utility Model Publication No. 58-32959/1983 has the lead retaining function because the flexible thin film is integrally laminated. However, since the lead is retained by only the force of frictional resistance of the flexible thin film, there remains the problem that the remainig lead is rotated at the time of writing by use of the remaining lead. In other words, the writing function by the remaining lead of this device is not sufficient.

SUMMARY OF THE INVENTION

It is an object of the present invention to provide a mechanical pencil which has both the lead retaining function and the writing function with the remaining lead and which can make effective utilization of the remaining lead.

The present invention provides a mechanical pencil having a writing lead protection pipe at its tip portion, wherein powder is dispersed and deposited onto the inner surface of the lead protection pipe so as to form a protuberance having a surface having hardness equal to, or higher than, that of the lead.

In an embodiment of the present invention, very small coil-like fibers having a surface having hardness equal to, or higher than, that of the writing lead are dispersed and deposited onto the inner surface of the lead protection pipe through a base material or a bonding agent.

In another embodiment of the present invention, an inorganic film having a protuberance having hardness equal to, or higher than, that of the writing lead is formed on the inner surface of the lead protection pipe.

In a further embodiment of the present invention, a ring-like lead retaining member is disposed in the lead protection pipe, and is equipped on its inner surface with a treated portion having a surface having hardness equal to, or higher than, that of the lead. A partial play is formed between the treated portion and the inner surface of the lead protection pipe and so that the lead retaining member is expansible and restorable.

PREFERRED EMBODIMENTS OF THE INVENTION

Figure 1:
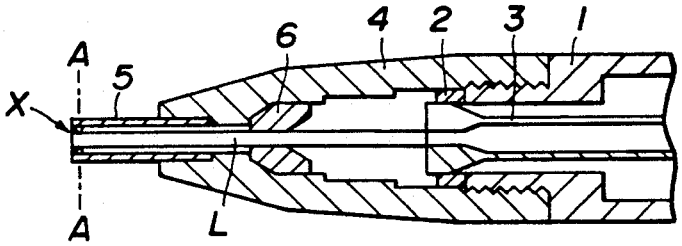
FIG. 1 is a sectional view of a mechanical pencil showing an embodiment of the present invention.

In FIG. 1, reference numeral 1 represents a tubular casing of a mechanical pencil. A chuck 3 having a chuck ring 2 fitted over the outer periphery of its front portion is inserted into the tubular casing 1 and the chuck ring 2 is used to open and close the chuck. Though a three-split chuck is shown as the chuck 3 in the drawing, the chuck may be the one that is generally referred to as a "ball chuck". A tubular tip member 4 is meshed with the front portion of the tubular casing 1, but it may be integral with the tubular casing 1. A lead protection pipe 5 made of a metal, a synthetic resin, ceramics, or the like, is pushed into the tip of the tip member 4, but the tip member 4 and the lead protection pipe 5 may be integral with each other. Reference numeral 6 represents a lead detent, which holds lightly a writing lead L to prevent the lead from retraction into the tip member at the time when the chuck 3 is retracted 4 but is not always indispensable. The construction described above is substantially the same as that of the prior art devices. In the present invention, means X for retaining a remaining lead is provided inside the lead protection pipe 5. Though the remaining lead retaining means X may be formed either throughout, or part of, the entire surface of the lead protection pipe 5, the means X is preferably formed at the tip portion as shown in FIG. 1 in order to utilize most effectively the lead L to its minimum length remained useless.

Hereinafter, each embodiment will be described in detail.

The first embodiment of the invention is shown in FIGS. 2 through 6. In this embodiment, powder is deposited onto the inner surface of the lead protection pipe 5 so as to form a protuberance 7 having a surface having hardness equal to, or higher than, that of the writing lead.

Examples of the powder that can be used include resin powder such as styrene, nylon, polyolefin, silicon, epoxy, methyl methacrylate, inorganic powder such as silica, alumina, potassium titanate, silicon nitride, silicon carbide, and powder (composite agent) formed by coating the powder described above with powder paint of acrylic type, urethane type, epoxy type, and the like. Furthermore, it is possible to use those kinds of powder products which are obtained by adsorbing or implanting inorganic powder having a smaller grain size than the resin powder into the latter by use of an automatic mortar, an ball mill, a jet mill, an atomizer, a hybridizer (a product of Nara Kikai Seisakusho Co., Ltd., Japan), etc. Various kinds of powder can be used so long as at least their surface coming into contact with the lead has hardness equal to, or higher than, that of the lead. The shapes of the powder described above are not particularly limitative and may be spherical, plate-like, bowl-like, and so forth. In the example shown in FIG. 2, the powder is directly deposited onto the inner surface of the lead protection pipe 5 so as to form a protuberance 7. In the example shown in FIG. 3, the protuberance 7 is formed by use of two kinds of powders (the composite product formed by implanting the inorganic powder into the resin powder). In the example shown in FIG. 4, the protuberance 7 is formed by depositing the powder and is then coated with a film by plating. This plating may be wet plating such as electroplating or electroless plating and dry plating such as vacuum deposition, sputtering, ion plating, and the like. The object of plating is to improve surface hardness cf rhe protuberance.

Figure 5:
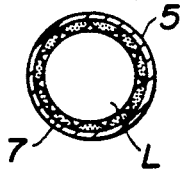
FIG. 5 is an enlarged sectional view of the lead protection pipe in accordance with still another embodiment of the present invention.
Figure 2:
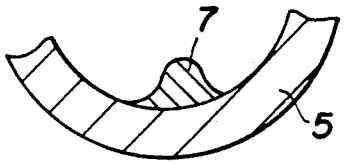
FIG. 2 is a partial enlarged sectional view of a lead protection tube, taken along line A—A of FIG. 1.
Figure 6:
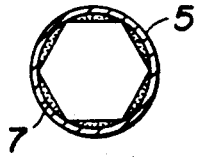
FIG. 6 is an enlarged sectional view of the lead protection pipe in accordance with still another embodiment of the present invention.
Figure 3:
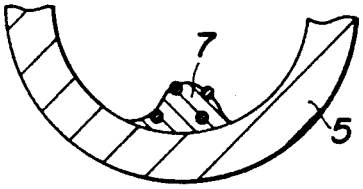
FIG. 3 is a partial enlarged sectional view of a lead protection pipe in accordance with another embodiment of the present invention.

FIGS. 5 and 6 show other examples of the protuberance 7 which is formed by gathering partially the powder on the inner surface of the lead protection pipe 5 so that the inner sectional surface becomes square and each side of the square comes into contact with the lead L as the protuberance.

The method of depositing the powder onto the inner surface of the lead protection pipe will be described with reference to the first embodiment of FIGS. 1 through 6.

The case will be explained where the resin powder is used as the powder, or the powder product obtained by forming the resin film on the inorganic powder or the powder product obtained by adsorbing or implating the inorganic powder to the resin powder is used. First of all, each of the powder is charged electrically which is carried out during spraying since the powder is charged electrically when sprayed by use of a spray, or the like. On the other hand, the charge is applied to the lead protection pipe 5. After the charged powder is attracted electrically to the inner surface of the lead protection pipe 5, the powder is heated, fused and deposited to form the protuberance 7. Alternatively, the lead protection pipe itself is heated, the powder is then sprayed and brought into contact with the inner surface of the lead protection pipe 5 and the protuberance 7 is thus formed.

Figure 7:
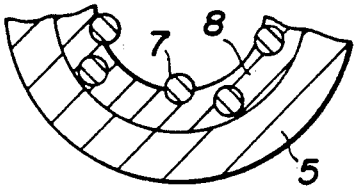
FIG. 7 is a partial enlarged sectional view of the lead protection pipe in accordance with still another embodiment of the present invention.
Figure 8:
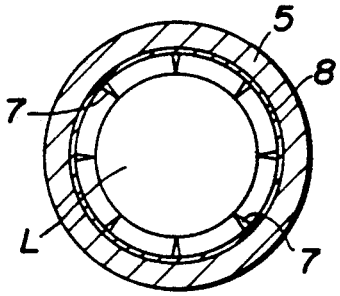
FIG. 8 is an enlarged sectional view of the lead protection pipe in accordance with still another embodiment of the present invention.

The second embodiment is shown in FIGS. 7 and 8, wherein a substrate or a bonding agent 8 is used and the powder is deposited onto the inner surface of the lead protection pipe 5 through the substrate 8 so as to form the protuberance 7 having a surface having hardness equal to, or higher than, that of the writing lead.

The powder used in the first embodiment can also be used in this embodiment but it is preferred to use silicon resin fine powder having a high frictional coefficient or powder having a needle-like crystal structure which is likely to impart the frictional resistance to the lead L.

Examples of the silicon resin fine powder are those having a network structure wherein the siloxane bond extends three-dimensionally and which is expressed by the following structural formula, particularly those having alkyl groups at the terminals of the molecular structures:

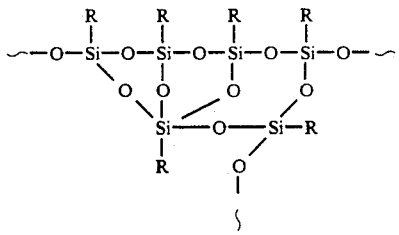

where R is an alkyl group.

Definite examples are those which are available on the market under the tradenames "Tospearl 120", "Tospearl 130", "Tospearl 145" and "Tospearl 240" (Products of Toshiba Silicon K.K.) having methyl groups bonded at the terminals. Depending on the grain diameter, the fine powder of this silicon resin fine powder can be used as it is or if the grain diameter is small, it can be used after it is adsorbed or implanted onto the surface of the resin powder having a greater grain diameter such as silicon, styren, nylon, polyolefin, epoxy, methyl polymethacrylate. The resin powder having a greater grain diameter can be used after it is adsorbed or implanted onto the surface of silicon having a smaller grain diameter. The adsorption and implantation method is the same as the method which is used in the first embodiment for adsorbing or implanting the inorganic powder to the resin powder.

Examples of the powder having the needle-like crystal structure are silicon nitride, silicon carbide, potassium titanate, zinc oxide, and the like. Particularly preferred is the needle-like crystal of zinc oxide (zince oxide whisker; produced by Matsushita Electric Industrial Co., Ltd.) having a three-dimensional shape. FIG. 8 shows the state where the protuberance 7 is formed by use of the powder having the needle-like structure through the bonding agent 8. The example shown in FIG. 8 is a preferred example because part of the needle-like crystal additionally gives a stronger frictional resitance to the lead L. The powder having the needle-like crystal structure is preferably used in combination with the other powder described in the first embodiment, because the powder having the needle-like structure is dispersed suitably and projects from the inner surface.

Examples of the substrate or bonding agent are paints of acrylic type, urethane type, epoxy type, etc., thermoplastic resins such as vinyl acetate type, styrene acrylic type, vinyl chloride type, thermosetting resins such as acrylic type, urethane type, epoxy type, liquid rubber such as silicon rubber, and plating solutions used for electroplating and electroless plating. The bonding agent can be selected irrelevant to the hardness of the writing lead.

Figure 4:
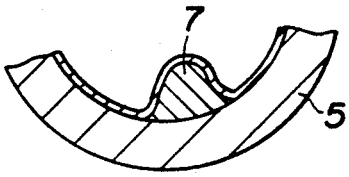
FIG. 4 is a partial enlarged sectional view of the lead protection pipe in accordance with still another embodiment of the present invention.

In this embodiment, fixability and hardness of the powder can be improved by applying plating to the surface of the powder in the same way as in FIG. 4 showing the first embodiment.

The method of depositing the powder onto the inner surface of the lead protection pipe in the second embodiment will be described.

Various methods can be employed depending on whether the bonding agent is a liquid or a solid.

If the bonding agent is liquid, after the lead protection pipe is dipped into the dispersion of the mixture of the bonding agent and the powder and an unnecessary solution is removed by air blow, permeation (so as to let the solution soak paper or the like), electrostatic removal, or the like and the coating layer is thus formed on the inner surface. Thereafter the protuberance is formed by solidifying the solution by suitable means such as heating. Incidentally, if the plating solution is utilized as the bonding agent, the powder can be deposited by plating such as electroplating or electroless plating.

The following methed can be employed when the bonding agent is solid (powdery).

A solvent is added to a mere mixture and dispersion of the powder and the bonding agent, or to a product obtained by adsorbing or implanting the powder to the bonding agent or to a product obtained by adsorbing or implanting the bonding agent to the powder and the treatment is then carried out in the same way as in the case where the bonding agent is the liquid as described above. Alternatively, the mere mixture and dispersion of the powder and the bonding agent or the product obtained by adsorbing or implanting the powder to the bonding agent or the product obtained by adsorbing or implanting the bonding agent to the powder is charged electrically by use of a suitable spray or the like, while the lead protection pipe of a metal is in advance charged electrically, so that the charged product is electrically deposited to the inner surface of the lead protection pipe. Then, heating is made so as to dissolve and deposite the bonding agent. Alternatively, the lead protection pipe itself is heated, then the powder and the bonding agent are sprayed and brought into contact with the inner surface of the lead protection pipe and the bonding agent molten and adhered.

Fixability can be improved by degreasing in advance the lead protection pipe 5 by dissolution, dipping, electrolysis, or the like.

Figure 9:
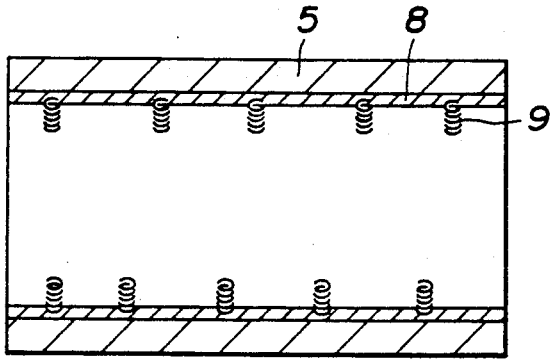
FIG. 9 is an enlarged longitudinal sectional view of the lead protection pipe in accordance with still another embodiment of the present invention.
Figure 10:
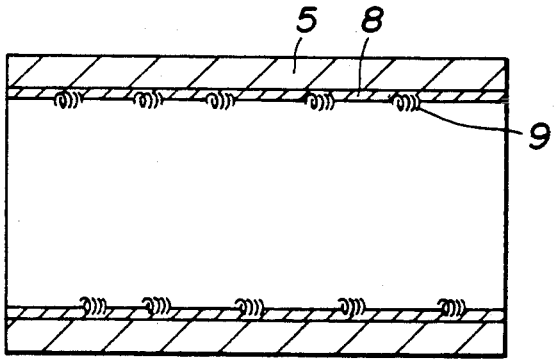
FIG. 10 is an enlarged longitudinal sectional view of the lead protection pipe in accordance with still another embodiment of the present invention.

The third embodiment is shown in FIGS. 9 and 10. Very small coil-like fibers 9 having a surface having a hardness equal to, or higher than, the hardness of the writing lead are dispersed and adhered onto the inner surface of the lead protection pipe 5 through the bonding agent 8.

This embodiment uses the very small coil-like fibers (e.g. carbon fibers having fiber diameter of 0.1–0.3 μm, coil diameter of about 5 μm, length of about 0.1 mm) in place of the powder of the second embodiment of FIGS. 7 and 8 and thee fibers are adhered via the bonding agent in accordance with the method of the second embodiment. It is important that the surface of the fibers coming into contact with the lead has a hardness equal to, or higher than, that of the writing lead. In the case of the fibers having a surface of a lower hardness, the surface may be subjected to suitable hardening treatment. If the powder illustrated as the example of the powder in the first embodiment of FIGS. 1–6 is used in combination with the coil-like fibers, the coil-like fibers are suitably dispersed and project to the inner surface, giving a favorable effect.

The difference between FIG. 9 and FIG. 10 lies in that whereas the coil-like fibers 9 extend in the axial direction of the lead protection pipe 5 in FIG. 9, the coil-like fibers 9 extend in the longitudinal direction of the pipe 5 in FIG. 10.

Figure 11:
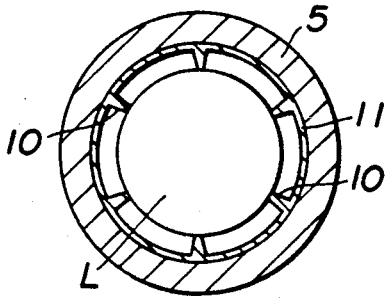
FIG. 11 is an enlarged sectional view of the lead protection pipe in accordance with still another embodiment of the present invention.
Figure 12:
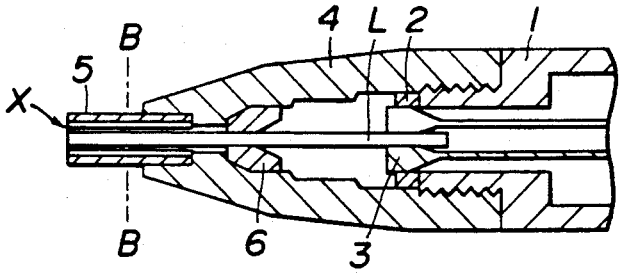
FIG. 12 is a sectional view of a mechanical pencil showing still another embodiment of the present invention.

The fourth embodiment is shown in FIG. 11, wherein an inorganic coating film 11 having protuberances 10 having a hardness equal to, or higher than, that of the writing lead L is formed on the inner surface of the lead protection pipe 5.

An example of the method of forming this inorganic coating film having the protuberances will be described.

First of all, the lead protection pipe 5 which is washed and degreased is placed inside a sputtering apparatus in such a manner that its opening faces a target. After an argon (Ar) gas is then introduced to $5\times10^2$ Torrs. Sputtering is then carried out at RF power of 1 KW for 4 hours and a Cr coating film having a plurality of substantially conical sharp protuberances of 25 μm high is formed on the inner surface of the tip portion of the lead protection pipe 5. The sample temperature rises to 450° C. during sputtering. The protuberances are formed by abnormal growth of the coating film, and whether or not they are formed is greatly dependent on the discharge plasma state during sputtering. Accordingly, the distance between the sample and the target and the gas pressure at the time of sputtering must be selected suitably. The gas pressure is suitably within the range of 2 to $20\times10^2$ Torrs in which the growing speed of the coating film becomes maximal and the distance between the sample and the target is suitably within the range of 30 to 60 mm in which the flowing current to the sample becomes maximal. It must be noted that the coating film will become flat and the size of the protuberance will become extremely small outside these ranges. The sample temperature during sputtering is preferably 300° C. or above in order to promote the growth of the coating film crystal grain and is preferably below 550° C. because a stainless steel is generally used as the material of the lead protection pipe. Furthermore, it is effective for the formation of the protuberance to apply a suitable bias voltage in order to promtoe the inflow of the current into the sample. The amterial of the inorganic film is not particularly limitative so long as the resulting protuberance has a hardness equal to or higher than that of the writing lead, but a material having a low melting point is preferred because the formation of the protuberance becomes easier. Particularly, the material is preferably a dielectric material because the current from inside the plasma can be utilized during its formation. It is also possible to form another coating fil mhaving a high hardness on a coating film after the latter having the protuberance is formed, in order to improve durability.

Besides the sputtering method described above, an ion plating method which can utilize effectively the inflowing current into the sample can be employed as the method of forming the inorganic coating film.

The size of the protuberance may be such that it comes into contact at least with the writing lead and its shape is preferably such that it has a pointed tip.

The fifth embodiment is shown in FIGS. 12 to 17.

The remaining lead retaining means X in this embodiment is such that a member having a treated inner surface portion having a hardness equal to or higher than the hardness of the lead L is disposed at a position inside the lead protection pipe 5. Hereinafter, this embodiment will be described in detail. Incidentally, the construction other than the lead protection pipe 5 portion is the same as the mebodiment shown in FIG. 1. Accordingly, like reference numerals as in FIG. 1 will be used and the explanation therefor will be omitted.

Figure 13:
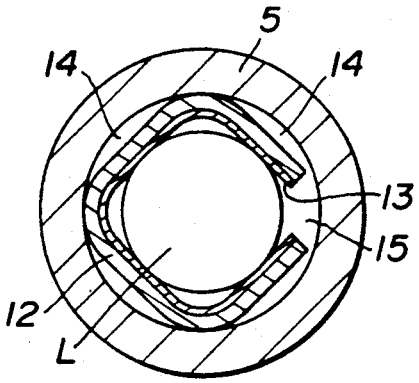
FIG. 13 is an enlarged sectional view of a lead protection pipe, taken along line B—B of FIG. 12.
Figure 14:
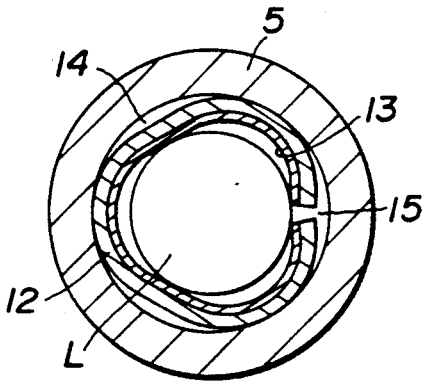
FIG. 14 is an enlarged sectional view showing the lead protection pipe in accordance with still another embodiment of the present invention.
Figure 15:
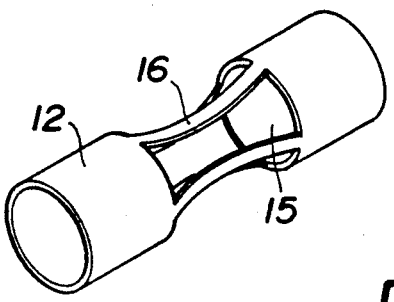
FIG. 15 is a perspective view showing a lead retaining member in accordance with still another embodiment of the present invention.
Figure 16:
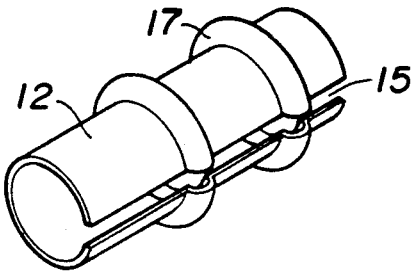
FIG. 16 is a perspective view showing still another embodiment of the lead retaining member.

A ring-like head retaining member 12 made of a metal, a synthetic resin, or the like, is inserted into the inner surface of the lead protection pipe 5. This lead retaining member 12 has on its inner surface a treated portion 13 having the surface whose surface hardness is equal to or higher than that of the writing lead L. A partial play 14 or a gap is provided between the lead retaining member 12 and the inner surface of the lead protection pipe 5 so that the lead retaining member 12 can be expanded and restored. In other words, various shapes can be employed for the lead retaining member 12. For example, it may have a substantially square sectional shape which has a slit 15 as shown in FIG. 13 and whose corners are rounded, or a substantially triangular shape whose corners are rounded as shown in FIG. 14, or shape which has slits 15 and reesses 16 at several positions in the longitudinal directions as shown in FIG. 15 or a shape which has a slit 15 and ring-like protuberances 17 as shown in FIG. 16. Though two narrow protuberances are shown disposed in FIG. 16 of the drawing, the protuberances may be formed continuously so as to form one wide protuberance. In the examples shown in FIGS. 13 to 15, a protuberance may be further formed on the inner surface in the longitudinal direction. Expansion and restoration of the lead retaining member 12 are attained by formation of the play 14 and the slit 15 in the examples shown in FIGS. 13 and 14. In the example shown in FIG. 15, they are attained by the play (not shown in the drawing) which is formed by the recess 16 and the slit 15. Furthermore, in the example shown in FIG. 16, they are formed by the existence of the play (not shown) formed by the protuberance 17 and by the existence of the slit 15.

As the definite example of the inner surface treatment of the lead retaining member 12, the method described in the first to fourth embodiments is applied. In other words, it includes the steps of the formation of the protuberance by dispersion and adhesion of the powder, dispersion and adhesion of the very small coil-like fibers and the formation of the inorganic coating film having the protuberance. The formation method described in the first to fourth embodiments can be employed, too.

Various other methods can also be employed as the example of the inner surface treatment of the lead retaining member 12. One of them is as follows. Three or more protuberances are formed on the inner surface of the lead retaining member in the longitudinal direction and a coating film (a film thickness of about 1 to about 10 μm) is formed on the inner surface by wet plating such as vacuum deposition, sputtering, ion plating.

In the embodiments shown in FIGS. 13, 14, 15 and 16, the inner surface treatment is made throughout the entire length of the lead retaining member 12 in the longitudinal direction but if the intermediate portion is cut in the embodiments shown in FIGS. 13 and 14 or in FIGS. 15 and 16 and the cut rear portion is used as the lead retaining member, the inner surface treatment may be made partially, and particularly preferably, at the front portion in consideration of the remaining lead.

Figure 17:
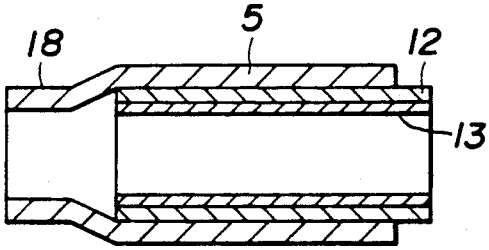
FIG. 17 is a sectional view showing the disposition state of the lead protection pipe and the lead retaining member in another embodiment of the invention.

FIG. 17 shows another embodiment showing the disposition of the lead protection pipe 5 and the lead retaining member 12. In this embodiment, a contracted portion 18 is formed at a front part of the lead protection pipe 5 and the rear end of the lead retaining member 12 projects from the rear end of the lead protection pipe 5. This embodiment provides the effect that the shake of the lead retaining member 12 can be prevented more reliably.

The present invention having the construction described above provides the following effects.

The first to fourth embodiments (FIGS. 1–11) of the invention provide the effect that since the protuberance of fiber of the inner surface of the lead protection pipe 5 bites delicately into the remaining lead, the lead protection pipe 5 is provided with a suitable lead retaining function and a writing function for the minimum length of the remaining lead. Further, the first to fourth embodiments do not require the conventioanl mechanical treatment such as contraction of the lead protection pipe 5 or the formation of slits in the lead protection pipe. Therefore, the problems of accuracy and productivity to satisfy the lead retaining function can be solved.

In the fifth embodiment of FIGS. 12–16, the treated portion of the inner surface of the lead retaining member bites delicately with the remaining short lead and the same function as that of the first to fourth embodiments (FIGS. 1–11) is provided to the lead protection pipe. In this embodiment, the lead retaining member 12 is disposed separately from the lead protection pipe 5, a partial play is provided between the lead protection pipe 5 and the lead retaining member 12, and the lead retaining member 12 is allowed to expand and restore. Accordingly, the problems with accuracy and productivity to satisfy the lead retaining function can be solved.

What is claimed is:

1. A mechanical pencil having a lead protection pipe at the tip thereof, wherein powder is dispersed and deposited to the inner surface of said lead protection pipe to form a protuberance having a surface having a hardness equal to, or higher than, that of a writing lead.

2. A mechanical pencil according to claim 1, wherein said powder is dispersed and deposited through a bonding agent.

3. A mechanical pencil having a lead protection pipe at the tip thereof, wherein coil-like fibers having a surface having a hardness equal to, or higher than, that of writing lead are dispersed and deposited to the inner surface of said lead protection pipe through a bonding agent.

4. A mechanical pencil having a lead protection pipe at the tip thereof, wherein an inorganic film having a protuberance having a hardness equal to, or higher than, that of a writing lead is formed on the inner surface of said lead protection pipe.

5. A mechanical pencil having a lead protection pipe at the tip thereof, wherein a ring-like lead retaining member is disposed inside said lead protection pipe, and said lead retaining member has on the surface thereof a treated portion having a surface having hardness equal to, or higher than, that of a writing lead, and a partial play relative to an inner surface of said lead protection pipe so that said lead retaining member can expand and restore.

* * * * *

UNITED STATES PATENT AND TRADEMARK OFFICE

CERTIFICATE OF CORRECTION

PATENT NO. : 5,085,534

DATED : February 4, 1992

INVENTOR(S) : Kenichi KAMAKURA ET AL

It is certified that error appears in the above-identified patent and that said Letters Patent is hereby corrected as shown below:

On the Title page, under item [19], "Kenichi" should be --Kamakura--; and in item [75] "Kamakura Kenichi" should be --Kenichi Kamakura--.

Signed and Sealed this

Twenty-seventh Day of April, 1993

*Attest:*

*Attesting Officer*

MICHAEL K. KIRK

*Acting Commissioner of Patents and Trademarks*